United States Patent [19]

Apostolides

[11] Patent Number: 4,893,213

[45] Date of Patent: Jan. 9, 1990

[54] MULTI-STAGE SOLENOID WITH TIME DELAYED ACTUATION

[75] Inventor: John K. Apostolides, Pittsburgh, Pa.

[73] Assignee: R.P.M. Industries, Washington, Pa.

[21] Appl. No.: 208,387

[22] Filed: Jun. 17, 1988

[51] Int. Cl.[4] ..... H01H 47/00

[52] U.S. Cl. ..... 361/191; 361/142; 361/195; 361/210

[58] Field of Search ..... 361/142, 166, 167, 191, 361/195, 210

[56] References Cited

U.S. PATENT DOCUMENTS

| | | | |
|---|---|---|---|
| 723,119 | 3/1903 | Zweigbergk | 361/191 |
| 4,276,631 | 6/1981 | Fujita et al. | 361/195 |

*Primary Examiner*—William M. Shoop, Jr.
*Assistant Examiner*—H. L. Williams
*Attorney, Agent, or Firm*—Reed Smith Shaw & McClay

[57] ABSTRACT

The present invention pertains to a multi-stage solenoid in a housing having a first set of electrical contacts and at least a second set of electrical contacts. The solenoid also has at least two coil windings electrically distinct from each other and disposed sequentially in the housing. Additionally, the solenoid uses a timing circuit separately connected through a first set of contacts to each of the coil windings to control when they each receive electricity thereby activating the corresponding magnetically responsive element. The solenoid also uses a plunger having a flange of an electrically conducting material. The plunger is disposed in an original position in the housing in contact with one of the magnetically responsive elements. When electricity is received by the coil windings associated with that magnetically responsive element, the flange of the plunger moves from its original position and into contact with the second set of electrical contacts such that electricity flows therebetween via the flange. At the same time, a different coil winding and its associated magnetic element can be electrically activated by the timing circuit to cause a mechanical displacement in that magnetic element which causes the activation of another device. Thus, the solenoid of the present invention can cause either only an electrical connection to be formed or a combined electrical connection and mechanical displacement.

5 Claims, 5 Drawing Sheets

MULTI-STAGE SOLENOID WITH TIME DELAYED ACTUATION

FIELD OF THE INVENTION

The present invention is related to solenoids. More specifically, the present invention relates to a multi-stage solenoid that has n distinct coil windings and n distinct elements.

BACKGROUND OF THE INVENTION

Solenoids are a type of electrical switch which is used for a multitude of purposes. A coil winding, which makes up the solenoid, is provided with electricity, resulting in a force applied to an element surrounded by the coil winding. This force, due to a magnetic field, moves the element. The movement of the element can then be used in turn to provide, for instance, a mechanical force at a desired location.

Heretofore, the mechanical force provided by solenoids is essentially in one direction, that is, there is only one element therein and it can only move in one direction at a time. The present invention allows for at least two elements to move independently and thus for at least two directions of mechanical force to be supplied or for a "staged" mode whereby the solenoid activates electrically first and mechanically second using the same plunger and flange mechanism.

SUMMARY OF THE INVENTION

The present invention pertains to a solenoid. The solenoid comprises a housing having a first set of contacts and at least a second set of contacts. The first set of contacts has a first positive contact and a first negative contact extending from and penetrating into the housing, and the second set of contacts has a second positive contact and a second negative contact extending from and penetrating into the housing. The solenoid also is comprised of n coil windings disposed in the housing, where n is an integer, and $n \geqq 2$. The n coil windings are electrically distinct from each other. Additionally, the solenoid is comprised of a timing circuit which is electrically connected through the first set of contacts and separately to each of the n coil windings. The timing circuit controls when each of the n coil windings receive electricity. There are n magnetically responsive elements disposed in the housing at original positions. The n elements are associated with the n coil windings such that each of the n coil windings is positioned with respect to its associated elements so when electricity is received by the ith coil winding, the element the coil winding is positioned with respect to is caused to move, where i is an integer and $1 \leqq i \leqq n$. Moreover, the solenoid is comprised of a plunger having a flange of an electrically conducting material. The plunger is disposed in the housing in contact with the element closest to the second set of contacts such that when electricity is received by the coil winding associated with the element closest the second set of contacts through the first set of contacts from the timing circuit, the element closes the second set of contacts, and moves the flange of the plunger from its original position into contact with the second positive contact and second negative contact such that electricity flows therebetween via the flange. The solenoid, furthermore, is comprised of first biasing means in contact with the plunger such that when electricity stops being received by the coil winding closest to the second set of contacts, the element closes to the second set of contacts and the flange of the plunger in contact therewith are moved back to their original positions.

Other details, objects and advantages of the invention will become apparent as the following description of the presently preferred embodiments and presently preferred methods of practicing the invention proceeds.

BRIEF DESCRIPTION OF THE DRAWINGS

In the accompanying drawings, the preferred embodiments of the invention and preferred methods of practicing the invention are illustrated, in which.

DESCRIPTION OF THE PREFERRED EMBODIMENT

Figure 1:
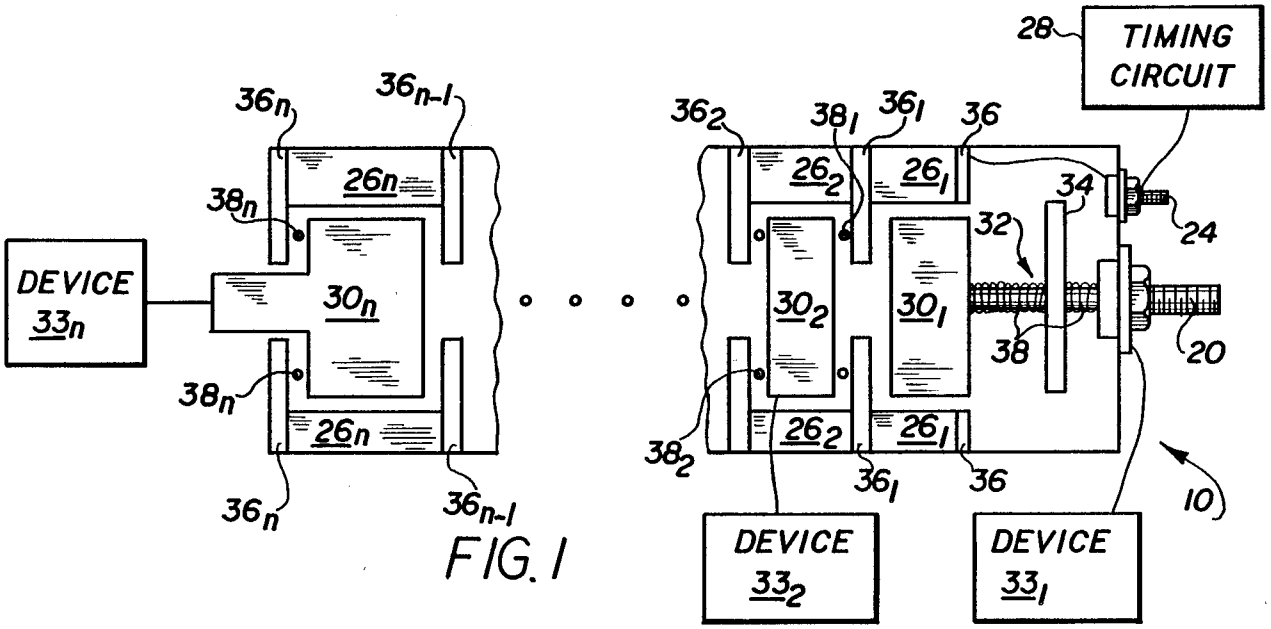
FIG. 1 is a schematic representation of a solenoid.
Figure 2:
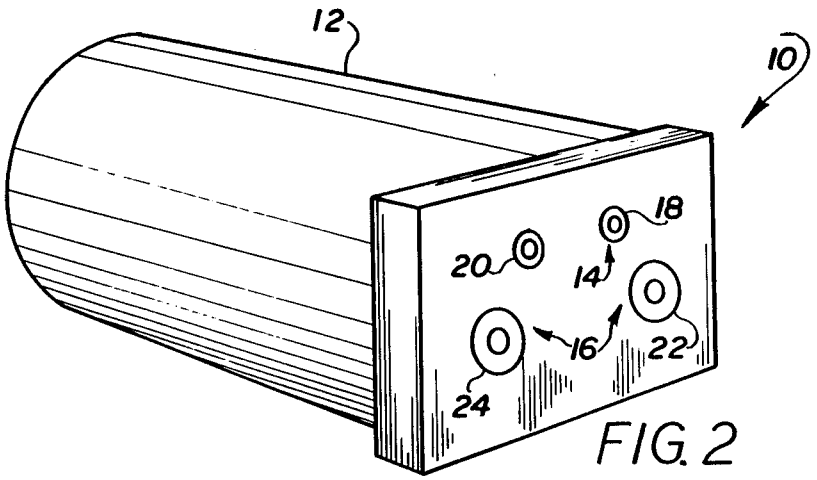
FIG. 2 is a perspective front view of the solenoid.

Referring now to the drawings wherein like reference numerals refer to similar or identical parts throughout the several views, and more particularly to FIGS. 1 and 2 thereof, there is shown a solenoid 10. The solenoid 10 is comprised of a housing 12 having a first set of electrical contacts 14 and at least a second set of electrical contacts 16. The first set of electrical contacts 14 has a first positive contact 18 and a first negative contact 20 which extends from and penetrates into the housing 12. Similarly, the second set of electrical contacts 16 has a second positive contact 22 and a second negative contact 24 which extends from and penetrates into the housing 12.

The solenoid 10 is also comprised of n coil windings 26 deposed in the housing 12, where n is an integer and $n \geqq 2$. The n coil windings 26 are electrically distinct from each other so that electricity received by any one coil winding 26 is not necessarily received by any other coil winding 26. A timing circuit 28 is electrically connected through the first set of electrical contacts 14 and separately to each of the n coil windings 26 for controlling when each of the n coil windings 26 receive electricity.

There are n magnetically responsive elements 30 disposed in the housing 12. The elements 30 are associated with the n coil windings 26 such that each of the n coil windings 26 is positioned with respect to its associated element so when electricity is received by the ith coil winding 26, the ith element 30 with which the ith coil winding 26 is associated is caused to move, where i is an integer and $1 \leqq i \leqq n$. The movement of the ith element 30 then causes some reaction, for instance, activation of a corresponding ith device 33. This activation can occur, for example, by the closing of a switch by way of a tab that is moved by the movement of the ith element 30. Preferably, the n coil windings 26 are disposed in series and the n associated elements 30 are disposed in series in the housing 12.

Each of the n coil windings 26 are preferably separated by an encapsulating wall 36. The magnetic field produced by the ith coil winding 26 when electricity is received by the ith coil winding essentially only directly effects the associated element with the ith coil winding by way of force thereon.

The solenoid 10, additionally is comprised of a plunger 32 having a flange 34, with the flange 34 being made of electrically conducting material. The plunger 32 is disposed in the housing 12 and is in contact with the element 30, closest to the second set of electrical contacts 16. When electricity is received by the coil winding 26, associated with the element $30_1$ from the first positive contact 18 of the first set of electrical contacts 14 and the timing circuit 28, the element $30_1$ moves the flange 34 of the plunger 32 into contact with the second positive contact 22 and second negative contact 24 such that electricity flows therebetween via the flange 34. This electricity from the second set of electrical contacts 16 then can be used, for example, to power the device $33_1$. The electricity received by the coil windings 26 passes out of the solenoid 10 by way of the first negative contact 20.

A first biasing means 38, such as a spring, is in contact with the plunger 32 such that when electricity stops being received by the coil winding $26_1$ closest to the second set of electrical contacts 16, the element $30_1$ and the flange 34 of the plunger 32 in contact therewith are moved back to their original positions. Similarly, there are biasing means 38 disposed in the housing 12 with respect to each element 30 to cause each element 30 to return to its original position after electricity is no longer received by the coil winding 26 with which the element 30 is associated.

Figures 3, 3A:
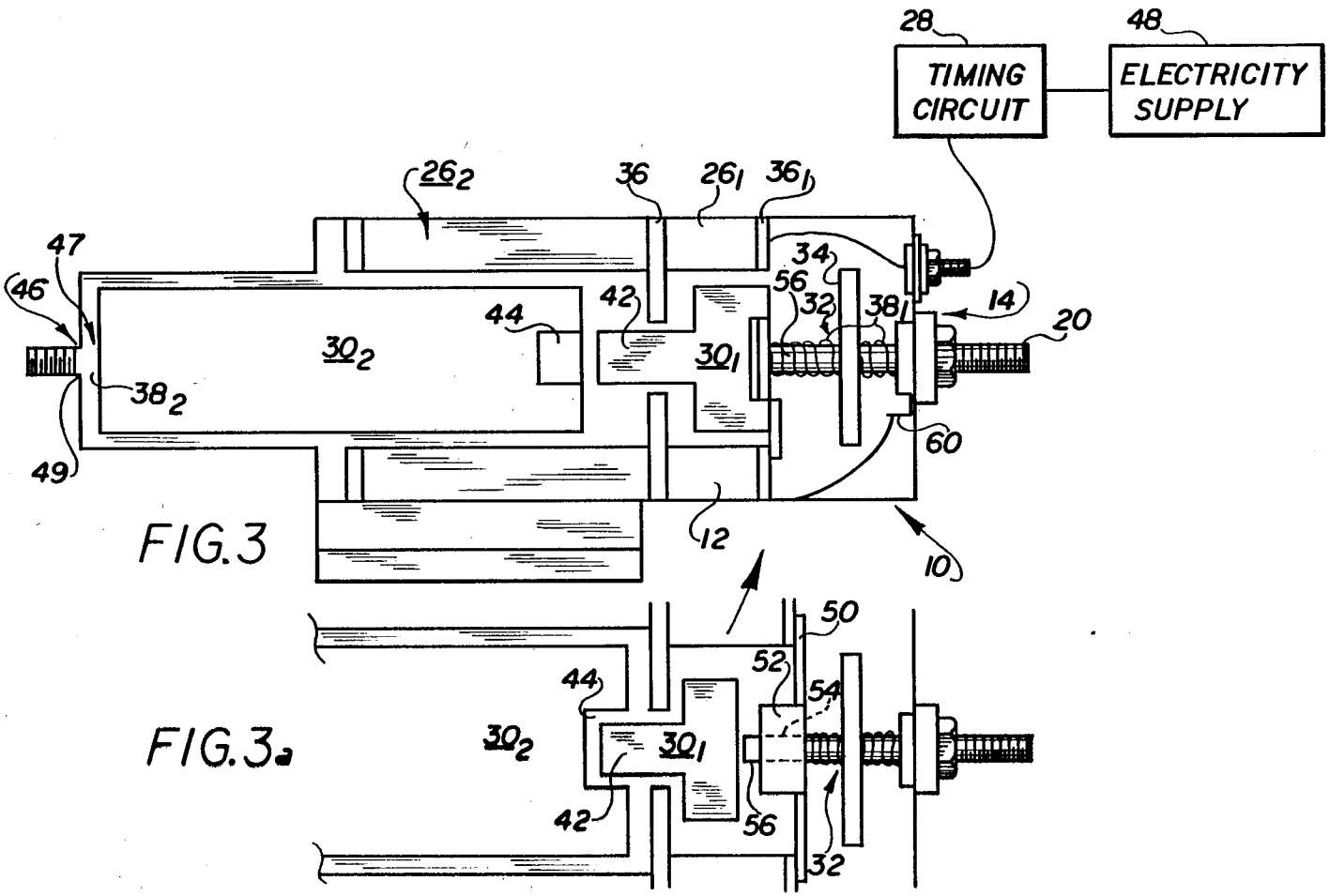
FIG. 3 and 3*a* are schematic representations of preferred embodiments of the solenoid.

In a preferred embodiment, as shown in FIG. 3, there are only two elements 30 disposed in the housing 12. The element $30_1$ closest to the second set of electrical contacts 16 is the first element $30_1$. The first element $30_1$ has an extension 42 which is non-magnetic. The second element $30_2$ has a depression 44 at its end closest to the first element $30_1$ to receive the first extension 42 of the first element $40_1$. Also, an insert 50 may be used as shown in FIG. 3*a*. The insert 50 is made of a material that is magnetically responsive and is preferably metal. The insert 50 is disposed on the coil winding $26_1$ with the encapsulating wall $36_1$ therebetween. The insert 50 has an insert tail 52 which the coil winding 26, is positioned about. There is also an insert hole 54 extending axially through the insert 50 and insert tail 52 which receives and allows a first end 56 of the plunger 32 to penetrate therethrough. The insert tail 52 causes increased attraction with respect to first element $30_1$ when coil winding $26_1$ receives electricity. Thus, the first element $30_1$ applies a greater force (relative to no insert 50 present) to the plunger 32 through its first end 56 in order to insure the flange 34 contacts the second set of electrical contacts 16.

Additionally, the coil windings $26_1$ and $26_2$ can be comprised of a hold-down coil winding and a pull-in coil winding which are positioned together but electrically isolated from each other, with for instance, insulation around electrical wire making up the coil winding 26. The hold-down coil is electrically connected to the first set of electrical contacts 14 through which electricity flows thereto, and which is controlled by the timing circuit 28. The hold-down coil provides a magnetic field strong enough to hold the first element $30_1$ in place after it has moved. The pull-in coil is electrically connected to the first positive contact 18 and the second negative contact 24 through a contact point 60 that extends therefrom. Preferably, when the timing circuit allows electricity to flow to the hold-down coil winding of coil winding $26_1$ current from the second positive contact 22 flows through the pull-in winding which provides the necessary force to move the plunger 32 via the first element $30_1$. When the flange 34 of the plunger 32 contacts the second set of electrical contacts 16, the current path through contact point 66 is essentially shorted out because electricity then travels between the second positive electrical contact 22 and the second negative electrical contact 2. The hold-down coil maintains the position of the plunger 32 since electricity continues to flow therein. The force associated with the pull-in coil is greater than the force associated with the hold-down coil since greater force is needed to move the plunger 32 rather than to hold the plunger 32 in place.

Similarly, coil winding $26_2$ can also be comprised of a hold-down coil and a pull-in coil. The electrical connections of the respective windings are to the same contacts as described above for the hold-down and pull-in coils of the coil winding $26_1$, except that, for instance, an additional switch is used to control electricity to the pull-down coil of coil winding $26_2$. When electricity from the timing circuit 28 provides electricity to the hold-down coil of the coil winding $26_2$, then this additional switch is closed allowing electricity from the second positive contact 22 to flow into the pull-in coil winding of the coil winding $26_2$.

The timing circuit 28 preferably controls electricity received by the first and second coil windings $26_1$ and $26_2$, respectively, such that the first coil winding $26_1$ receives electricity for a first period of time, causing the first element $30_1$ and the flange 34 of the first plunger 32 contacting the first element $30_1$ to contact the first set of electrical contacts 14. After the first period of time has passed, the timing circuit 28 stops electricity from being received by the first coil winding $26_1$ for a second period of time. During this second period of time, the first element $30_1$ and the plunger 32 move back to their original positions due to the biasing means $38_1$. After the second period of time has passed, timing circuit 28 controls electricity received by the second element $30_2$ for a third period of time such that the end 47 of the second element $30_2$ extends through the opening 46 of the housing 12. Electricity during the third period of time is also received by the first coil winding $26_1$ such that the above described operation of the element $30_1$ with respect to the device 33 occurs. Timing circuit 28 can, for example, simply be a series of switches (not shown) that, when closed, allow electricity to be received by a corresponding coil winding 26. The opening and closing of the switches can be accomplished, for instance, with a timer that controls when each switch opens or closes, or by external sensors that are connected to the switches, as is well known in the art. Biasing means $38_2$ causes the second element $30_2$ to return to its original position after current ceases therein.

In the operation of the preferred embodiment, electricity from an electricity supply 48 is received by the timing circuit 28. The timing circuit 28 allows electricity to be received by the first coil winding $26_1$. Electricity in the coil winding $26_1$ results in a magnetic field being produced therefrom, forcing the first element $30_1$ toward the first set of electrical contacts 14. The plunger 32 that is in contact with the first element $30_1$ consequently moves forward such that the flange 34 on the plunger 32 contacts the second positive contact 22 and second negative contact 24. The electricity then flows between the second positive contact 22 and second negative contact 24 via the flange 34. The electricity passing through the second set of electrical contacts 16 can, for instance, be used with respect to an engine (not shown) having a prelubrication system. The electricity from the second set of electrical contacts 16 actuates an oil pump to prelubricate the engine before the engine is started. Electricity is received by the first coil winding $26_1$ until the oil pressure in the engine attains a desired oil pressure. Referring to FIG. 3, there is shown a graph of oil pressure versus time after the oil pump is actuated. The time T1 identified in FIG. 3 corresponds to the time that the first coil winding $26_1$ no longer receives electricity due to the timing circuit 28 preventing electricity from passing thereto.

Once electricity is no longer received by the first coil winding $26_1$, the magnetic field produced therefrom ceases, and consequently the force on element $30_1$ ceases. The spring which has been compressed due to the motion of the first element $30_1$ then expands, forcing the plunger 32 back to its original position. The movement of the plunger 32 to its original position causes first element $30_1$ which is in contact with the plunger 32 to also return to its original position. When the plunger 32 returns to its original position, the flange 34 of the plunger 32 is no longer in contact with the second set of electrical contacts 16, and electricity through the set of electrical contacts 16 ceases.

Figure 4:
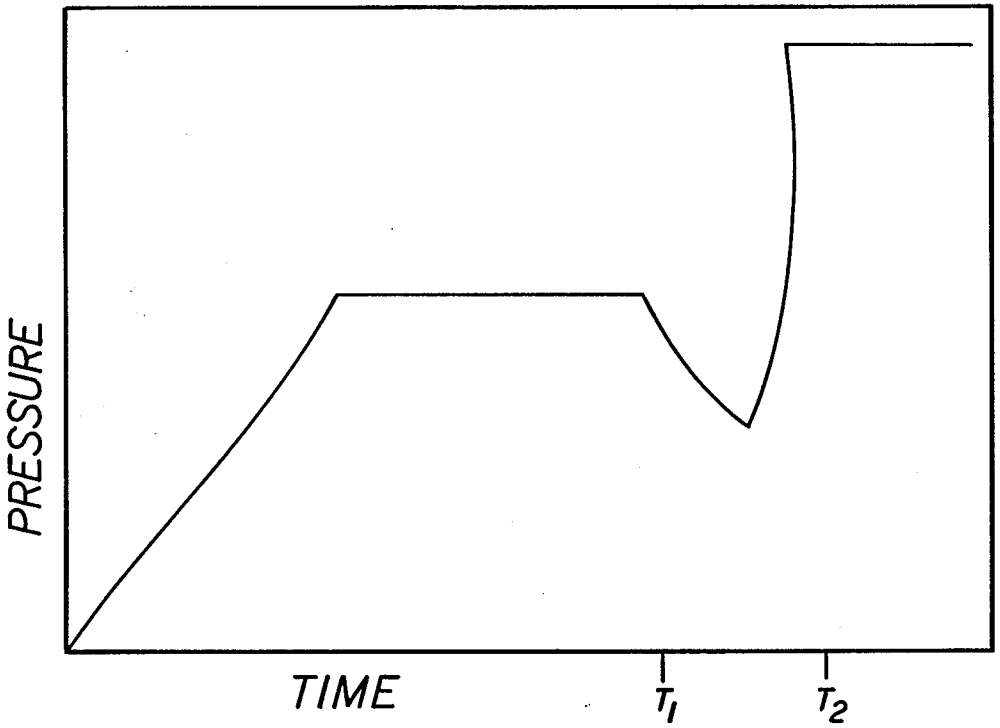
FIG. 4 is a graph of oil pressure versus time.

The timing circuit 28 prevents any electricity from being received by the solenoid 12 for a second period of time. Referring to FIG. 3, this second period of time is identified as the period of time between T1 and T2. During this time, the oil pump also ceases operation, since electricity is no longer being received by it, and oil pressure in the engine drops off as is evidenced in the graph of FIG. 4.

At the end of the second period of time $T_2$, the timing circuit 28 allows electricity to be received by the first coil winding $26_1$ and the second coil winding $26_2$. The action of the first element $30_1$, which has been described above, then repeats itself, causing the oil pump to once again operate. The electricity in the second coil winding $26_2$ results in a magnetic field being produced therefrom and a force being applied on second element $30_2$. The force on second element $30_2$ causes the second element $30_2$ to move toward the opening 46 in the solenoid 12. The mechanical action resulting from the movement about the second element $30_2$ is used to activate the starter of the engine and cause the engine to engage. A main oil pump then also engages, resulting in a greater oil pressure present in the engine, as indicated in FIG. 3, after time T2.

Figure 5:
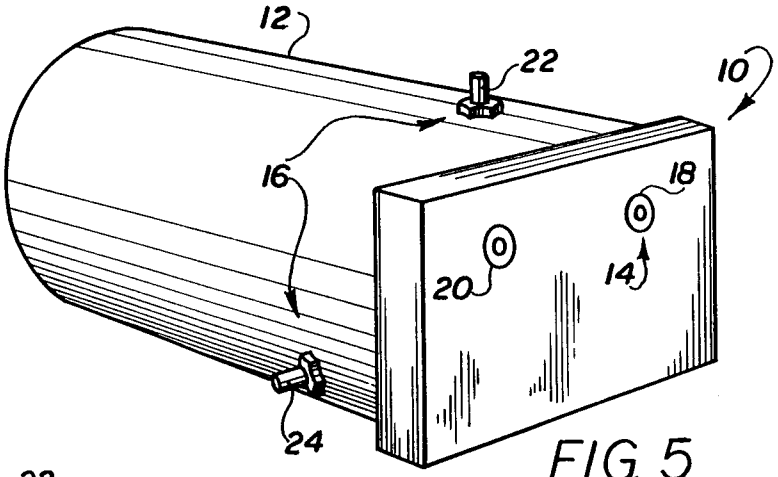
FIG. 5 is a perspective front view of an alternative embodiment of the solenoid.
Figure 6:
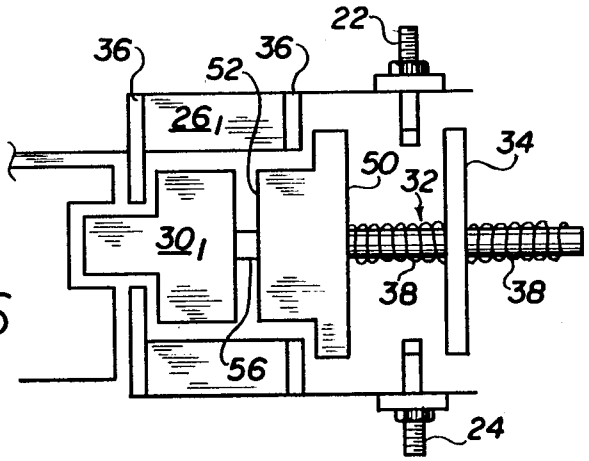
FIG. 6 is a fragmentary schematic representation of an alternative embodiment of the solenoid.

Alternatively, the solenoid 10 can have the second set of contacts 16 on and through the housing 12 as shown in FIG. 5. The plunger 32, instead of moving away from the coil winding $26_1$ during operation, is instead pulled toward the coil winding 26 with a corresponding change in the magnetic flux from the coil winding $26_1$. The remaining design is the same as described above in the preferred embodiment.

Although the invention has been described in detail in the foregoing for the purpose of illustration, it is to be understood that such detail is solely for that purpose and that variations can be made therein by those skilled in the art without departing from the spirit and scope of the invention as described by the following claims.

I claim:

1. A solenoid comprising:

the element closest to the second set of electrical contacts moves the flange of the plunger from its original position into contact with the second positive contact and second negative contact such that electricity flows therebetween via the flange; and first biasing means in contact with the plunger such that when electricity stops being received by the coil winding closest to the second set of electrical contacts, the element closest to the second set of electrical contacts and the flange of the plunger in contact therewith are moved back to their original positions.

a housing having a first set of electrical contacts, and at least a second set of electrical contacts, said first set of electrical contacts having a first positive contact and a first negative contact extending from and penetrating into the housing, said second set of electrical contacts having a second positive contact and a second negative contact extending from and penetrating into the housing;

n coil windings disposed in the housing, where n is an integer and $n \geqq 2$, said n coil windings being electrically distinct from each other;

a timing circuit electrically connected through the first set of electrical contacts and separately to each of the n coil windings for individually controlling when each of the n coil windings receives electricity;

n magnetically responsive elements disposed in the housing at original positions and associated with the n coil windings such that each of the n coil windings is positioned with respect to its associated element so when electricity is received by the ith coil winding, the element the coil winding is positioned with respect to is caused to move, where i is an integer and $1 \leqq i \leqq n$;

a plunger having a flange made of electrically conducting material disposed in the housing and in contact with the element closest to the second set of electrical contacts such that when electricity is received by the coil winding associated with the element closest the second set of electrical contacts through the first set of electrical contacts from the timing circuit,

2. A solenoid as described in claim 1 wherein the n coil windings are disposed sequentially and the n associated elements are disposed sequentially in the housing; and wherein there are biasing means in contact with each element for causing the element to move back to its original position after the coil winding with which it is associated stops receiving electricity

3. A solenoid as described in claim 2 wherein the n coil windings are each separated by an encapsulating wall and the magnetic field produced by the ith coil winding when electricity is received by the ith coil winding essentially only directly effects the associated element with the coil winding.

4. A solenoid as described in claim 3 wherein $n=2$, and the element closest the second set of electrical contacts is a first element having a first extension, and a second element has a depression at its end closest to the first element to receive the first extension of the first element, said timing circuit controlling a first coil winding associated with the first element and a second coil winding associated with the second element such that electricity is received by the second coil winding at a predetermined time after the first coil winding receives electricity.

5. A solenoid as described in claim 4 wherein the housing has an opening; and wherein the timing circuit controls the electricity received by the first and second coil windings such that the first coil winding receives electricity for a first period of time, causing the first element and the flange of the first plunger contacting the first element to contact the second set of electrical contacts, then the timing circuit stopping electricity from being received by the coil windings for a second period of time, said first element and first plunger moving back to their original positions during this second period; then after the second period of time, the timing circuit controls electricity received by the second element for a third period of time such that the end of the second element extends through the opening of the housing.

* * * * *